United States Patent [19]

Nakajima et al.

[11] Patent Number: 4,497,296

[45] Date of Patent: Feb. 5, 1985

[54] ELECTRONIC CONTROL SYSTEM FOR CARBURETOR AND CONTROL METHOD THEREFOR

[75] Inventors: Masataka Nakajima, Tokyo; Yasushi Mase, Hachioji, both of Japan

[73] Assignee: Nissan Motor Company, Limited, Yokohama, Japan

[21] Appl. No.: 437,001

[22] Filed: Oct. 27, 1982

[30] Foreign Application Priority Data

Oct. 30, 1981 [JP] Japan ..... 56-173985

[51] Int. Cl.[3] ..... F02M 51/00

[52] U.S. Cl. ..... 123/440; 123/489; 123/491

[58] Field of Search ..... 123/440, 489, 491

[56] References Cited

U.S. PATENT DOCUMENTS

| | | | |
|---|---|---|---|
| 3,949,551 | 4/1976 | Eichler et al. | 123/491 |
| 4,321,903 | 3/1982 | Kondo et al. | 123/489 |
| 4,359,029 | 11/1982 | Furuhashi et al. | 123/489 |
| 4,365,599 | 12/1982 | Ikeura | 123/489 |
| 4,373,187 | 2/1983 | Ishii et al. | 123/489 |
| 4,380,985 | 4/1983 | Otsuka et al. | 123/440 |
| 4,389,996 | 6/1983 | Yaegashi et al. | 123/491 |

FOREIGN PATENT DOCUMENTS

| | | | |
|---|---|---|---|
| 41433 | 4/1981 | Japan | 123/440 |

*Primary Examiner*—Parshotam S. Lall

*Attorney, Agent, or Firm*—Schwartz, Jeffery, Schwaab, Mack, Blumenthal & Koch

[57] ABSTRACT

A control system for an electronically controlled carburetor operative during engine start-up employs an oxygen-concentration ($O_2$) sensor which is accurate only a given engine temperature range. Engine temperature in the vicinity of the $O_2$ sensor is compared to a predetermined threshold to determine whether the $O_2$ sensor is sufficiently warm. When the $O_2$ sensor is cold, the carburetor is controlled via an OPEN LOOP method wherein the carburetor is operated at a constant state so as to produce a predetermined constant air/fuel mixture. When the $O_2$ sensor is warm, its output is processed to determine whether the air/fuel mixture is too rich or too lean as part of a CLOSED LOOP control method in which carburetor operation is adjusted in order to correct the air/fuel ratio in accordance with the output of the $O_2$ sensor.

12 Claims, 7 Drawing Figures

START
P1
STARTER SW. ON ?
NO
END OF TASK
YES
P2
Tw < Tref
P3
OPEN LOOP CONTROL
END OF TASK
NO
P8
START TIMER
P9
t ≧ tset
NO
P10
OPEN LOOP CONTROL
END OF TASK
YES
P6
ENABLE CLOSED LOOP CONTROL
P7
CLOSED LOOP CONTROL
END OF TASK

ELECTRONIC CONTROL SYSTEM FOR CARBURETOR AND CONTROL METHOD THEREFOR

BACKGROUND OF THE INVENTION

The present invention relates generally to an electronically controlled carburetor for an internal combustion engine. More particularly, the invention relates to an air/fuel ratio control process in the electronically controlled carburetor which selectively uses either CLOSED LOOP or OPEN LOOP control during engine cranking depending on engine operating conditions.

In the CLOSED LOOP air/fuel ratio control method, an exhaust gas sensor, such as an oxygen sensor, produces a feedback signal determining the duty cycle of a control signal. As is well known, the oxygen sensor signal value is proportional to the oxygen concentration in the exhaust gas assuming that the engine is fully warmed up. On the other hand, if the engine temperature is excessively low, the oxygen sensor signal value will not be proportional to the exhaust gas oxygen concentration. Therefore, as long as the oxygen sensor temperature is below a given temperature, CLOSED LOOP control cannot accurately be performed and, therefore, OPEN LOOP control is carried out.

In some of the air/fuel controls, selection or switching between CLOSED LOOP and OPEN LOOP control is made on the basis of engine coolant temperature. However, in such air/fuel ratio controls, after the engine, and thus the oxygen sensor, is warmed up, the oxygen sensor will cool faster than the engine coolant if the engine is stopped for a while. Therefore, it is possible that the oxygen sensor will operate inaccurately even though the engine coolant temperature is in an acceptable range, upon restarting the engine under warmed condition. In such circumstances, if CLOSED LOOP air/fuel ratio control is carried out, emission control will not be performed accurately.

SUMMARY OF THE INVENTION

Therefore, it is an object of the present invention to provide an air/fuel control process in an electronically controlled carburetor, which can control or eliminate noxious exhaust emissions during engine start-up and warm-up.

According to the present invention, the electronically controlled carburetor is adapted to selectively perform CLOSED LOOP control or OPEN LOOP control of the air/fuel ratio depending upon engine operating conditions during engine start-up. The electronic air/fuel ratio control process is carried out by a controller which is responsive to a starter switch turning ON to perform OPEN LOOP control until the temperature of an $O_2$ sensor reaches a predetermined temperature suitable for CLOSED LOOP control.

In the preferred embodiment, OPEN LOOP control is carried out while the $O_2$ sensor output is equal to or below a given threshold, or for a predetermined period of time after the engine is started.

BRIEF DESCRIPTION OF THE DRAWINGS

The present invention will be understood more fully from the detailed description given herebelow and from the accompanying drawings of the preferred embodiment of the invention, which, however, should not be taken as limitative to the invention but for elucidation and explanation only.

In the drawings.

DESCRIPTION OF THE PREFERRED EMBODIMENT

Figure 1:
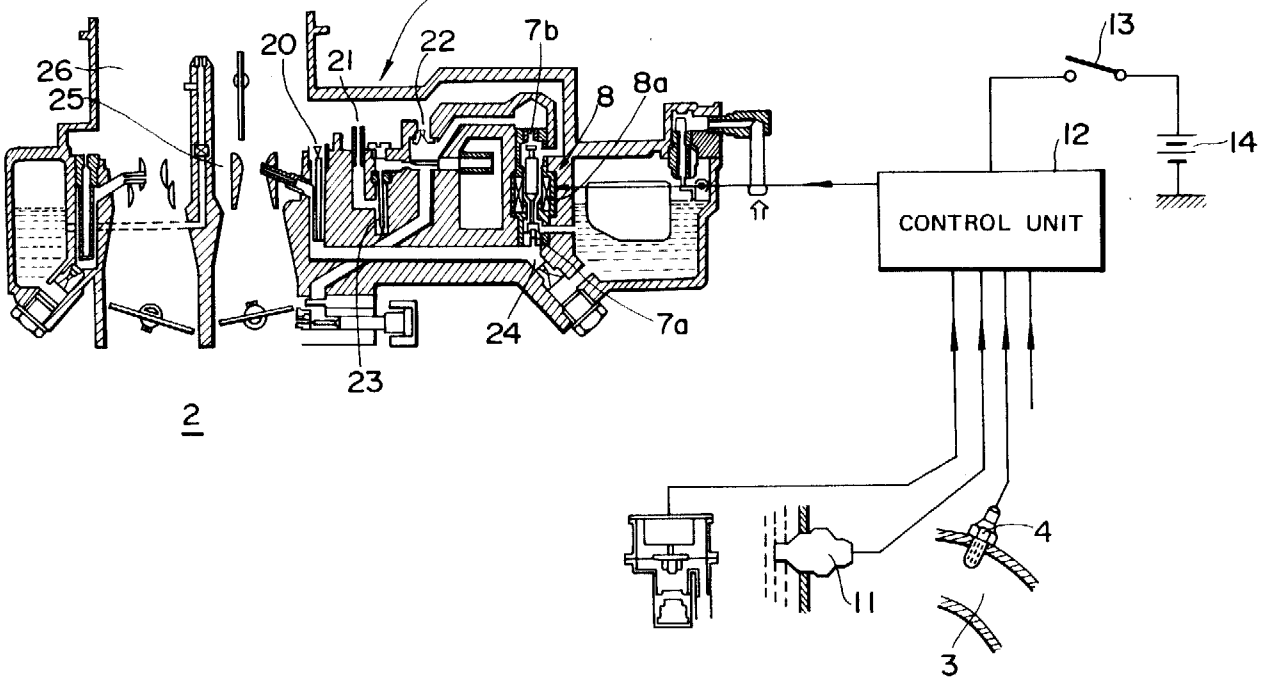
FIG. 1 is a diagrammatic illustration of the preferred embodiment of an electronically controlled carburetor according to the present invention.

Referring now to the drawings, particularly to FIG. 1, there is illustrated the preferred embodiment of an electronically controlled carburetor according to the present invention. In this electronically controlled carburetor, a control unit 12 receives an $O_2$ sensor signal as a feedback signal from an $O_2$ sensor 4 which is inserted into an exhaust passage 3. The control unit 12 also receives an engine coolant temperature signal from a coolant temperature sensor 11 inserted into a water jacket provided in the walls of the engine. The control unit 12 is further connected to a starter switch 13 and, in turn, to a vehicle battery 14.

A carburetor 6 generally comprises a main air bleed 20, a slow economizer bleed 21, a slow air bleed 22, a slow jet 23, and a main jet 24. The carburetor 6 further includes an air/fuel ratio control valve 8 with an electromagnetic actuator 8*a*, a main correction jet 7*a* and a correction slow air bleed 7*b*. A fuel nozzle 10 of the carburetor 6 has an outlet exposed into a venturi 25 of an air induction passage 26.

The ratio of the energized period and deenergized period of the electromagnetic actuator 8*a* is controlled to control opening and closing of the main and slow correction jets in the air/fuel ratio control valve 8. For enrichment of the air/fuel mixture, the on-duty of the electromagnetic actuator 8*a* is reduced based on the lead-indicative $O_2$ sensor signal under closed loop control. On the other hand, if the $O_2$ sensor signal is indicative of a rich air/fuel mixture, the on-duty of the electromagnetic actuator 8*a* is increased. While the electromagnetic actuator 8*a* is energized by an on-duty component of a control signal fed from the control unit 12, the correction slow air bleed 7*b* is closed to reduce the vacuum in the slow air bleed 22 for reducing carburetion of the fuel. On the other hand, when the electromagnetic actuator 8*a* is deenergized, the correction slow air bleed 7*b* is opened to increase the vacuum in the slow air bleed to increase carburetion.

In the construction as set forth, the control unit 12 performs air/fuel ratio CLOSED LOOP control based on the $O_2$ sensor signal representative of the richness of leanness of the mixture provided that the $O_2$ sensor is warmed up to a temperature above a given temperature. The control unit 12 determines the duty cycle of a control signal depending on the $O_2$ sensor signal value to correct the air/fuel ratio to the stoichiometric value. On the other hand, if the $O_2$ sensor is excessively cold and thus is inactive, OPEN LOOP control will be performed to produce the control signal with a constant duty cycle.

The control signal produced by the control unit 12 is fed to the air/fuel ratio control valve 8 to control the ratio of the energized period and the deenergized period of the electromagnetic actuator 8*a*.

Figure 2:
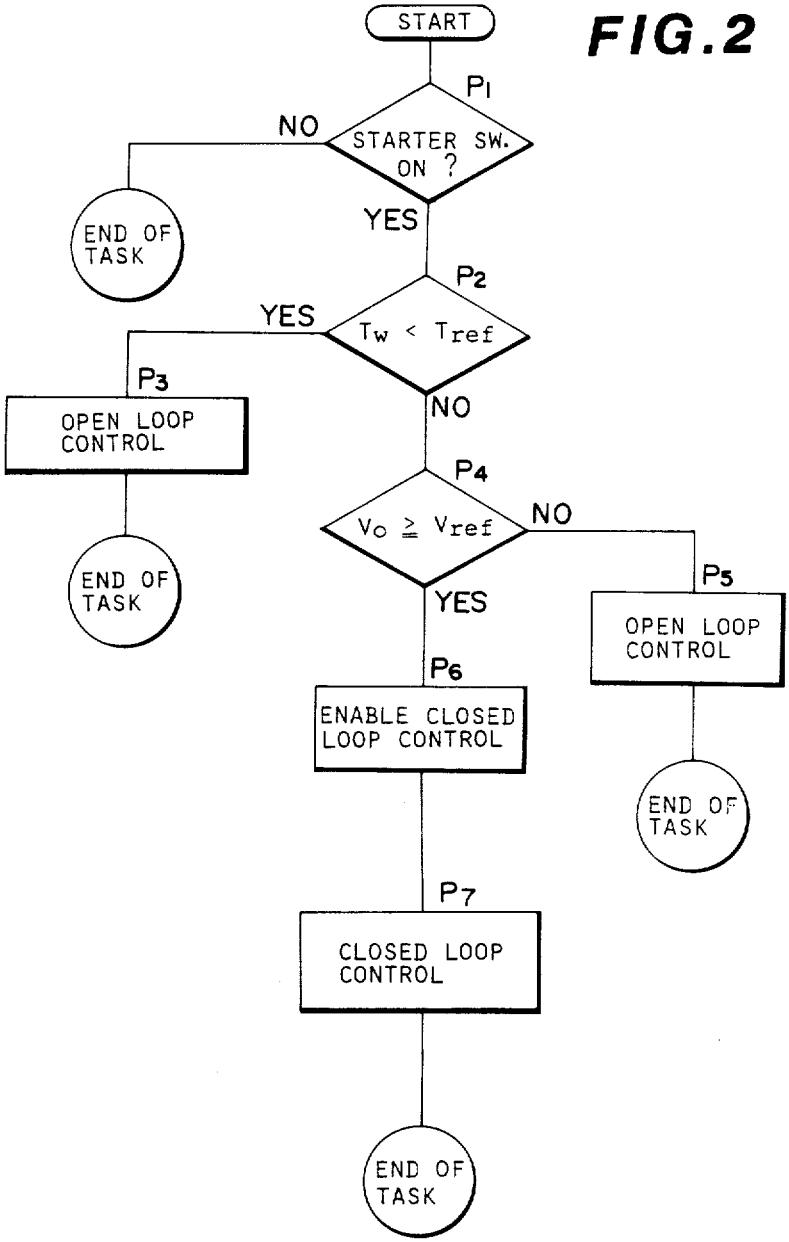
FIG. 2 is a flow chart of the first embodiment of an air/fuel ratio control method of the invention.

FIG. 2 shows the first embodiment of an air/fuel ratio control program selectively performing either CLOSE LOOP control or OPEN LOOP control during engine start-up, and determining the duty cycle of the control signal for CLOSED LOOP control.

As will be appreciated, the air/fuel control program is executed in the control unit 12 repetitively at a given interval. First, a starter switch position is checked at a block $P_1$. If the starter switch is OFF, the execution of the program goes to END whereupon a different control program for normal engine operation starts. When the starter switch 12 is ON, then the engine coolant temperature signal value $T_W$ from the coolant temperature sensor 11 is compared with a preset value $T_{ref}$, at a block $P_2$. If the engine coolant temperature signal value $T_W$ is less than the preset value $T_{ref}$, the control unit 12 produces a control signal with a given constant duty cycle for OPEN LOOP control and disables the CLOSED LOOP control, at a block $P_3$.

Figure 3:
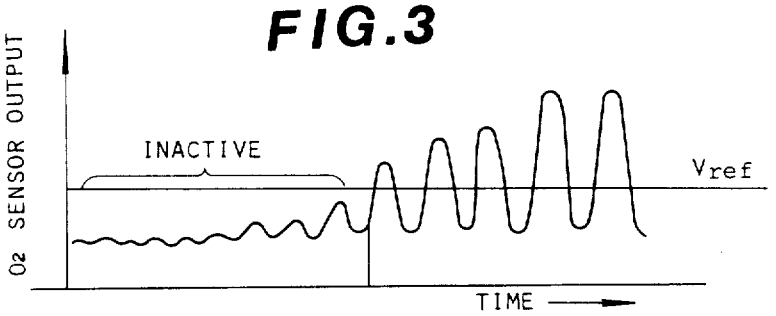
FIG. 3 shows the variation of the output of an $O_2$ sensor with respect to the engine operating time.
Figure 5:
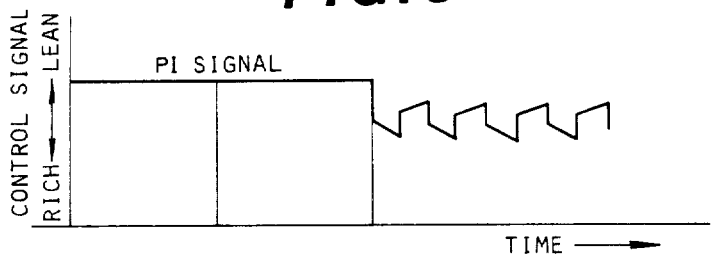
FIG. 5 shows the variation of the air/fuel ratio control signal duty cycle according to the control method of FIG. 2.

If the engine coolant temperature signal value $T_W$ is equal to or greater than the preset value $T_{ref}$, the $O_2$ sensor output voltage $V_o$ is compared with a given threshold $V_{ref}$, at a block $P_4$. When the $O_2$ sensor output voltage $V_o$ is less than the given threshold $V_{ref}$, the control unit 12 produces the OPEN LOOP control signal at a block $P_5$ similar to the block $P_3$, as shown in FIGS. 3 and 5. If the $O_2$ sensor output voltage $V_o$ is equal to or greater than the given threshold $V_{ref}$, the control unit 12 permits execution of CLOSED LOOP control, at a block $P_6$.

Figure 4:
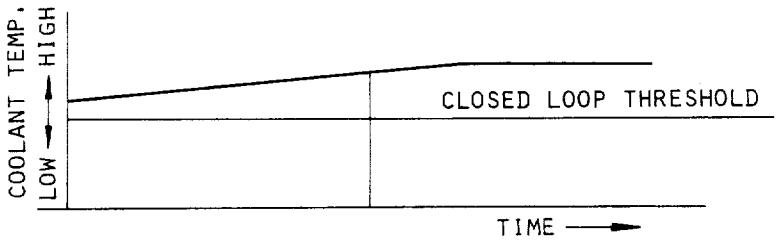
FIG. 4 shows the variation of an engine coolant temperature with respect to engine operating time.

As will be appreciated from FIGS. 3 to 5, even when the engine coolant temperature is higher than a CLOSED LOOP threshold, the CLOSED LOOP control is still disabled as long as the $O_2$ sensor output level exceeds the given threshold $V_{ref}$. When the $O_2$ sensor output level exceeds the given threshold $V_{ref}$, as illustrated in FIG. 3, the known CLOSED LOOP control is performed, at a step $P_7$.

In the CLOSED LOOP control, a known P-I control is performed to determine the duty cycle of the closed loop control signal. The general operation of the P-I control has been disclosed in U.S. Pat. No. 4,046,118, issued on Sept. 6, 1977, to Aono. The disclosure in U.S. Pat. No. 4,046,118 is herewith incorporated by reference. In the CLOSED LOOP control, the duty cycle of the control signal is determined with a proportional component and the integral component variable as shown in FIG. 5.

The control signal is fed to the electromagnetic actuator 8*a* to control the ratio of the energized period and deenergized period thereof to control the air/fuel ratio at the stoichiometric value.

Figure 6:
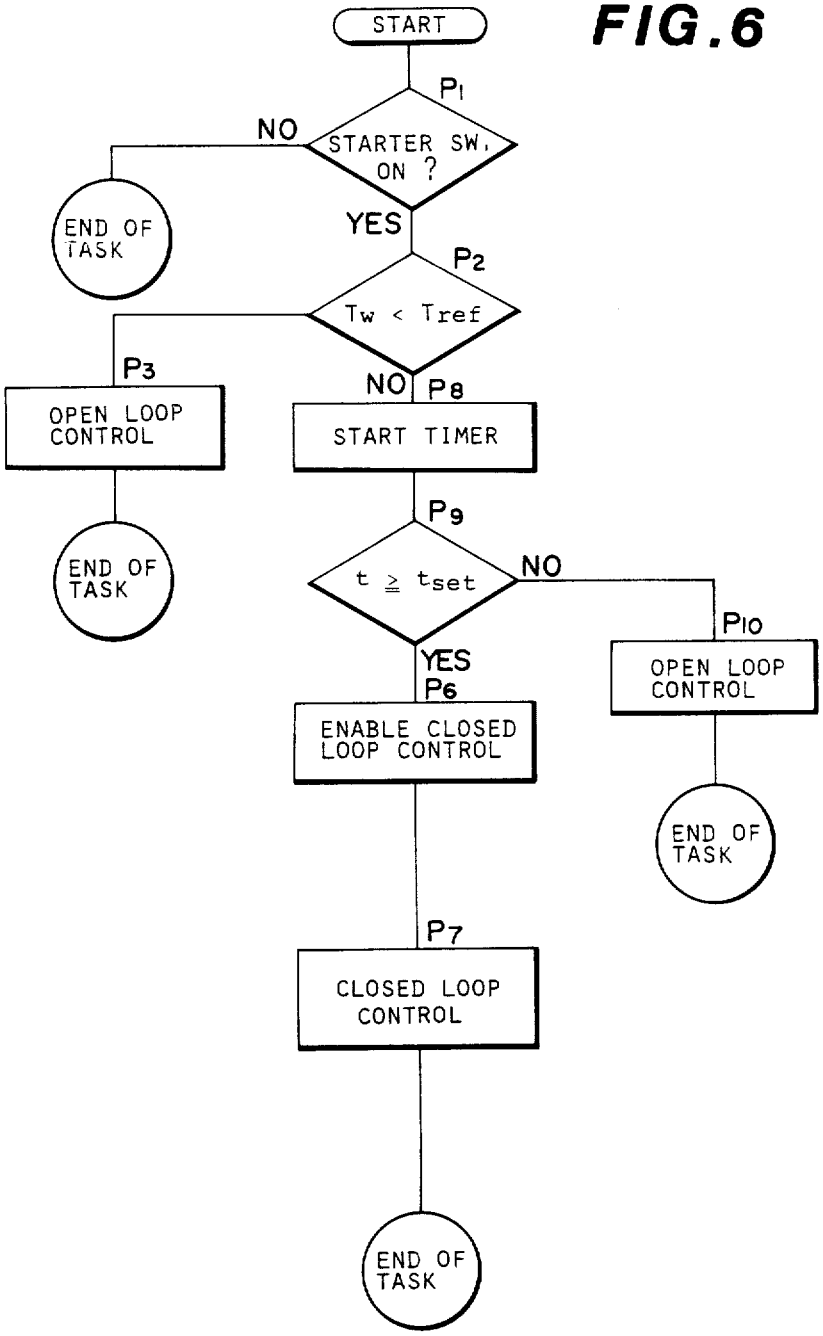
FIG. 6 is a flow chart of the second embodiment of the air/fuel ratio control method.

FIG. 6 shows the second embodiment of the air/fuel ratio control program. In this embodiment, the control unit 12 disables CLOSED LOOP control for a given period of time in response to turning ON of the starter switch 13. In this embodiment, as in the foregoing first embodiment, the starter switch position and the engine coolant temperature are respectively checked at the blocks $P_1$ and $P_2$. When the starter switch 13 is ON and the engine coolant temperature signal value $T_W$ is greater than the preset value $T_{ref}$, a timer starts measurement of the period of time, at a block $P_8$. If the measured time t is shorter than a predetermined period $t_{set}$ is checked at a block $P_9$, the control unit 12 performs OPEN LOOP control with a control signal of a given constant duty cycle, at a block $P_{10}$. On the other hand, if the measured time is equal to or greater than the predetermined period, CLOSED LOOP control, as in the foregoing first embodiment, is enabled at blocks $P_7$.

Figure 7:
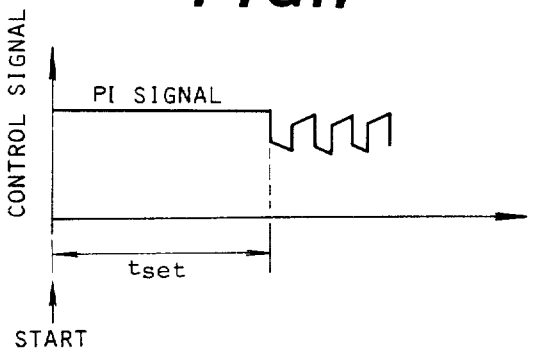
FIG. 7 shows the variation of the air/fuel ratio control signal duty cycle according to the control method of FIG. 6.

The variation of the duty cycle of the control signal is illustrated in FIG. 7. It should be appreciated that the predetermined period $t_{set}$ should be long enough to sufficiently warm up the $O_2$ sensor.

As will be appreciated, according to the present invention, the CLOSED LOOP control may be disabled as long as the $O_2$ sensor is inactive, during which time the controller 12 outputs a constant duty cycle signal for OPEN LOOP control.

What is claimed is:

1. An air/fuel ratio control system for an electronically controlled carburetor of an engine comprising:

an air/fuel ratio control means in said carburetor for controlling carburetion ratio of fuel supplied to said engine, said air/fuel ratio control means including an actuator responsive to a control signal to control said carburetion ratio of the fuel;

a starter switch which is turned on during engine cranking;

an engine coolant temperature sensor for producing a first signal representative of engine coolant temperature;

an $O_2$ sensor for producing a second signal representative of air/fuel ratio;

a CLOSED LOOP disabling condition detecting means for detecting a preselected CLOSED LOOP disabling condition, said detecting means being responsive to turning on of said starter switch to detect said preselected condition to produce a third signal when said preselected condition is satisfied; and a control unit for selectively performing CLOSED LOOP and OPEN LOOP control for producing said control signal for controlling the operation of said actuator, said control unit performing said CLOSED LOOP control for controlling the actuator operation based on said second signal so as to maintain the air/fuel ratio at a stoichiometric value when said first signal value is above a given value and, otherwise, performing said OPEN LOOP control, said control unit being responsive to said third signal to disable said CLOSED LOOP control even when said first signal value is above said given value.

2. The system as set forth in claim 1, wherein said CLOSED LOOP disabling condition detecting means is associated with said $O_2$ sensor to detect an output level of said $O_2$ sensor below a predetermined threshold to produce said third signal.

3. The system as set forth in claim 1, wherein said CLOSED LOOP disabling condition detecting means measures a time period from when said starter switch is turned ON to produce said third signal as long as the measured period is shorter than a given period.

4. The system as set forth in claim 3, wherein said given period is longer than a period in which said $O_2$ sensor is sufficiently warmed-up.

5. An air/fuel ratio control system for an electronically controlled carburetor of an engine comprising:

an air/fuel ratio control means in said carburetor for controlling carburetion ratio of fuel supplied to said engine, said air/fuel ratio control means including an actuator responsive to a control signal to control said carburetion ratio of the fuel;

a starter switch which is turned on during engine cranking;

an engine coolant temperature sensor for producing a first signal representative of engine coolant temperature;

an $O_2$ sensor for producing a second signal representative of air/fuel ratio;

a CLOSED LOOP condition detecting means for detecting a preselected CLOSED LOOP condition, said detecting means being responsive to said starter switch to detect an engine cranking condition and to be active to produce a third signal when said preselected condition is dissatisfied; and a control unit for selectively performing CLOSED LOOP and OPEN LOOP control for producing said control signal for controlling the duty cycle of said actuator, said control unit performing said CLOSED LOOP control for varying the duty cycle of the actuator based on said second signal so as to maintain the air/fuel ratio at a stoichiometric value when said first signal value is above a given value and, otherwise, performing said OPEN LOOP control to produce said control signal indicative of a predetermined constant duty cycle of said actuator, said control unit being responsive to said third signal to disable said CLOSED LOOP control even when said first signal value is above said given value.

6. The system as set forth in claim 5, wherein said CLOSED LOOP condition detecting means is associated with said $O_2$ sensor to detect an output level of said $O_2$ sensor above a predetermined threshold to produce said third signal when said output level is below said predetermined threshold.

7. The system as set forth in claim 5, wherein said CLOSED LOOP condition detecting means measures a time period from when said starter switch is turned ON to produce said third signal as long as the measured period is shorter than a given period.

8. The system as set forth in claim 7, wherein said given period is longer than a period in which said $O_2$ sensor is sufficiently warmed-up.

9. An air/fuel ratio control method for an internal combustion engine with an electronically controlled carburetor and an air/fuel ratio control means for controlling carburetion ratio of fuel supplied by said carburetor, and a control unit operating in conjunction with an oxygen-concentration sensor signal indicative of richness or leanness of the air/fuel ratio of the mixture, comprising the steps of:

detecting engine coolant temperature above a predetermined temperature to produce a first signal;

detecting a starter switch being turned ON to produce a second signal;

detecting a predetermined CLOSED LOOP condition irrespective of said engine coolant temperature condition, in response to said second signal, to produce a third signal when said CLOSED LOOP condition is dissatisfied; and selectively performing CLOSED LOOP control and OPEN LOOP control, said CLOSED LOOP control being performed in response to said first signal, and, otherwise, said OPEN LOOP control is performed, said CLOSED LOOP control being disabled regardless of the presence of said first signal in response to said third signal.

10. The method as set forth in claim 9, wherein an output level of said oxygen-concentration sensor is detected to produce said third signal when said output level is below a given threshold.

11. The method as set forth in claim 9, wherein a time period from said said starter switch is turned ON and measured time period is compared with a given period to produce said third signal as long as said measured period is shorter than said given period.

12. The system as set forth in claim 11, wherein said given period is longer than a period in which said $O_2$ sensor is sufficiently warmed-up.

* * * * *